US006630769B2

(12) United States Patent
Custodis et al.

(10) Patent No.: US 6,630,769 B2
(45) Date of Patent: Oct. 7, 2003

(54) FLAT ILLUMINATION DEVICE WITH MIRROR SURFACE

(75) Inventors: Udo Custodis, Munich (DE); Michael Seibold, Munich (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 10/132,210

(22) Filed: Apr. 26, 2002

(65) Prior Publication Data

US 2002/0180341 A1 Dec. 5, 2002

(30) Foreign Application Priority Data

May 8, 2001 (DE) ..... 101 22 211

(51) Int. Cl.[7] ..... H01J 5/16
(52) U.S. Cl. ..... 313/113; 313/110; 313/485
(58) Field of Search ..... 313/110, 113, 313/114, 115, 485

(56) References Cited

U.S. PATENT DOCUMENTS

| | | | |
|---|---|---|---|
| 5,604,410 | A | 2/1997 | Vollkommer et al. |
| 5,994,849 | A | 11/1999 | Vollkommer et al. |
| 6,034,470 | A | 3/2000 | Vollkommer et al. |

FOREIGN PATENT DOCUMENTS

| | | |
|---|---|---|
| EP | 0 733 266 | 9/1996 |
| EP | 0 839 436 | 5/1998 |
| WO | WO 98/43277 | 10/1998 |
| WO | WO 99/66538 | 12/1999 |

*Primary Examiner*—Vip Patel
(74) *Attorney, Agent, or Firm*—Robert F. Clark

(57) ABSTRACT

A flat illumination device (1), includes a base plate and a front plate which are connected to form an at least partially transparent vessel which, in its interior, has an ionizable fill. In a partial region of the vessel, at least one of the two plates is at least in part provided with a mirror surface. An unmirrored partial region (12) of the vessel is designed to realize an illumination function.

10 Claims, 1 Drawing Sheet

FLAT ILLUMINATION DEVICE WITH MIRROR SURFACE

TECHNICAL FIELD

The invention relates to a flat illumination device which, in addition to an illumination function, also has a mirror function, i.e. the illumination device can also be used as a mirror which can be illuminated.

BACKGROUND ART

Illuminateable mirrors are usually produced by arranging one or more separate lights outside the actual mirror surface, for example to the side of or above the mirror surface. The generally small depth of a mirror ultimately cannot be put to good use on account of the dimensions of the separate light(s) used for the illumination. Suitable lights typically comprise at least one lamp, including the lamp holder and, if appropriate, associated lamp reflector, a light housing or a light cover and, when using discharge lamps, for example fluorescent lamps, additionally an electrical operating unit.

DISCLOSURE OF THE INVENTION

It is an object of the present invention to provide an improved illuminateable mirror.

This object is achieved by a flat illumination device, comprising a base plate and a front plate, which are connected to form an at least partially transparent vessel which, in its interior, has an ionizable fill, at least one of the two plates, in a partial region of the vessel, being at least partially provided with a mirror surface, and an unmirrored partial region of the vessel being designed to realize an illumination function. Particularly advantageous configurations are given in the dependent claims.

By contrast to the structure of conventional illuminateable mirrors comprising a plurality of separate components, which was outlined in the introduction, the invention proposes a flat illumination device with an integrated mirror surface.

The illumination device according to the invention is based on a flat lamp, comprising a base plate and a front plate, which are connected to form an at least partially transparent vessel which, in its interior, has an ionizable fill.

The connection may be produced, for example, by means of a frame which is arranged between the two plates and is connected thereto. In this way, the frame also defines the distance between the two substantially planar plates. The frame usually runs along the edge regions of both plates, in order that it be possible for the entire surface extent of both plates to be utilized as completely as possible to form the vessel.

The frame can be dispensed with if at least one of the two plates, in its edge region, is shaped with suitable convexity, so that the two assembled plates form a vessel even without a frame.

According to the invention, only a partial region of the vessel is designed to realize the illumination function. It is preferable for this partial region to extend along at least a part of the edge region of the vessel. In the remaining region of the vessel, at least one of the two plates is at least partially provided with a mirror surface.

Optionally, the vessel may also be divided into two or more chambers which separate the regions of the flat illumination device which are designed for the mirror and illumination functions from one another. In this way, it is possible to restrict the ionizable fill to the region which is designed for the illumination function, i.e. for only the corresponding chamber(s) to be filled with the ionizable fill which is provided for the discharge. This is advantageous in particular when using relatively expensive fills, for example xenon. The chamber which surrounds the mirror surface may be filled with a less expensive gas (mixture), for example nitrogen or dried air.

The flat lamp of the illumination device according to the invention is particularly preferably of the dielectric barrier discharge lamp type. In this type of flat lamp, at least some of the electrodes are separated from the fill of the discharge vessel by a dielectric. For this purpose, the electrodes are arranged either on the outer surface of the discharge vessel, as disclosed in EP 0 839 436 B1, in which case the wall of the discharge vessel itself functions as said dielectric, or on the inner surface of the discharge vessel, in which case the electrodes are additionally covered with a dielectric layer, as disclosed in WO 98/43277. The electrodes are usually designed as structures which resemble conductor tracks and which are applied to the inner surface, for example by means of screen printing. In a similar way, the dielectric layer is printed onto these strip-like electrodes. For further details in this connection, reference is made to WO 99/66538.

This type of lamp is preferably operated in accordance with the pulsed operating method disclosed in EP 0 733 266 B1, since this has proven particularly efficient compared to the conventional method of operating these dielectric barrier discharges with a sinusoidal alternating voltage. In any event, the plurality of adjacent electrodes is selected to alternate. As a result, the discharge is lit in each case between adjacent electrodes.

A partial region of at least one of the two plates, for example a partial region of the inner surface of the base plate, is provided with the abovementioned mirror surface. While this mirrored partial region functions in a conventional way as a mirror, the unmirrored partial region is used to realize the illumination function, i.e. as a lamp. For this purpose, the unmirrored partial region is printed with the abovementioned electrode structure and the dielectric layer. In operation, the gas discharge takes place only in this partial region, generating the light required for the illumination function either on its own or in combination with a phosphor layer which has been applied to the wall of the discharge vessel.

A further advantage is that the illumination device is easy to clean, since the entire front side, i.e. the mirror region including lamp region, is delimited by the planar, single-piece front plate.

The surface area of the mirrored partial region typically corresponds to more than 50%, or better more than 60%, preferably more than 70%, particularly preferably more than 80% of the front surface of the front plate, in order, on the one hand, to be able to provide a mirror area which is sufficiently large for use with respect to the area required for the entire illumination device. On the other hand, the area of the unmirrored partial region which functions as a lamp must be sufficiently large to be able to ensure sufficient, shadow-free illumination which is as uniform as possible. In view of this requirement, it has proved appropriate if the surface area functioning as a lamp corresponds to more than 5%, or better approx. 10% or more of the front surface of the front plate.

BRIEF DESCRIPTION OF THE DRAWINGS

In the text which follows, the invention is explained in more detail with reference to the example of a dielectric barrier flat lamp of this type, since, on account of the fact that the production steps, including the printing steps, can be readily automated, this appears particularly suitable. However, the invention expressly also encompasses conventional flat lamps. In the drawings.

BEST MODE FOR CARRYING OUT THE INVENTION

Figure 1A:
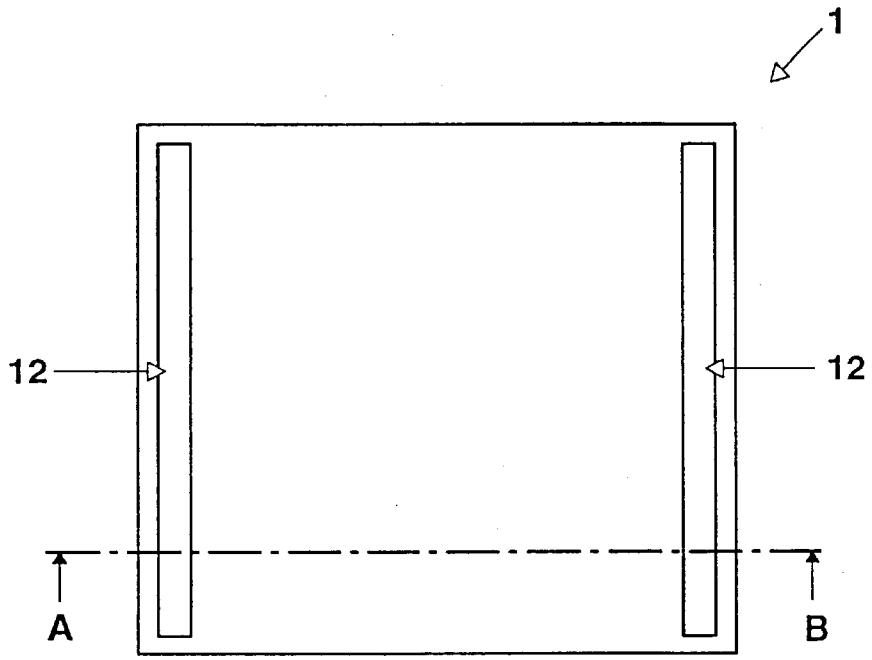
FIG. 1*a* shows a plan view of an illumination device according to the invention with mirror surface.
Figure 1B:
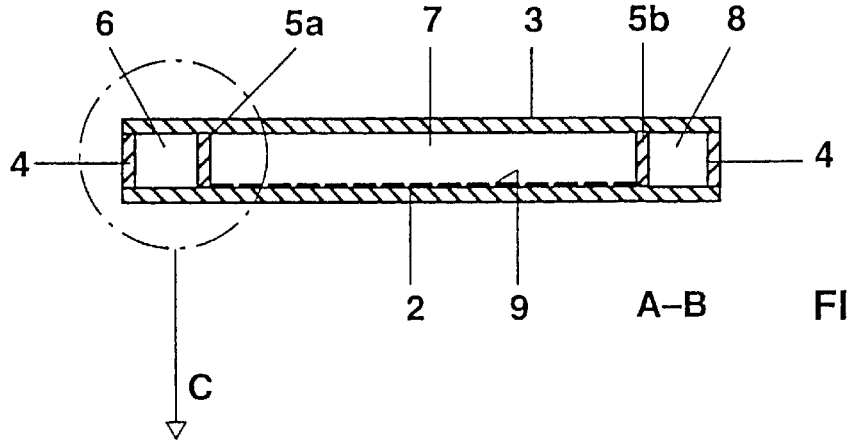
FIG. 1*b* shows a sectional illustration on line AB of the illumination device from FIG. 1*a,*
Figure 1C:
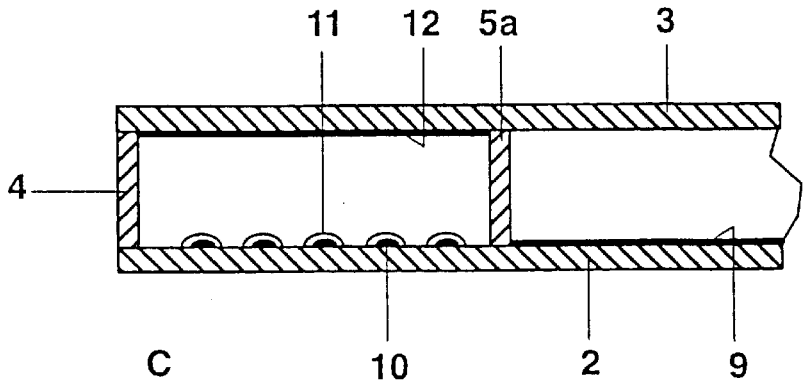
FIG. 1*c* shows an enlarged excerpt of a partial region C of the illustration shown in FIG. 1*b*.

FIGS. 1*a* to 1*c* diagrammatically depict a plan view, a sectional illustration on line AB and an enlarged excerpt of a partial region C of an illumination device 1 according to the invention, comprising a rectangular base plate 2, a likewise rectangular front plate 3, a frame 4 and two partitions 5*a*, 5*b*. Said components 2 to 5 all consist of glass.

The frame 4, which runs around the edges of base plate 2 and front plate 3, connects these two plates 2, 3 to form a flat vessel. The two partitions 5*a*, 5*b* divide this vessel 2, 3, 4 into three cuboidal chambers 6 to 8. The two outer chambers 6, 8 are identically sized, elongate and extend along two opposite narrow sides of the flat illumination device 1. Each of the two outer chambers 6, 8 serves as a discharge vessel of in each case an elongate partial flat lamp, i.e. ultimately serves to realize the illumination function. Further explanations in this respect are given below. The middle chamber 7 is considerably larger than the two outer chambers 6, 8 and is used as a mirror. For this purpose, a mirror surface 9 is vapor-deposited on the inner surface of the base plate 2 in the region of the middle chamber 7. The mirror surface 9 corresponds to approximately 90% of the basic surface area of the front plate 3.

The two outer chambers 6, 8 are filled with xenon at a cold filling pressure of approx. 10 kPa. Since relatively expensive xenon is being used, dividing the vessel into chambers 6–8 has the advantage that the quantity of xenon required can be restricted just to these chambers 6, 8 which are functioning as discharge vessels. If cost considerations of this nature are of no importance, there is no need for the arrangement to be divided into chambers, and the entire vessel 2, 3, 4 can be filled with xenon. Strip-like electrodes 10 comprising silver solder, which are covered with a soldering glass layer 11 acting as a dielectric barrier, are printed on the inner surface of the base plate 2 within each outer chamber 6, 8. A phosphor layer 12 is applied to the inner surface of the front plate 2 within each outer chamber 6, 8. The phosphor layer 12 comprises a three band phosphor mixture, which can be used to produce white light. In this case, the phosphor layer 12 converts the ultraviolet (UV) radiation which, in operation, is produced by the discharge within each outer chamber 6, 8 into visible light. The UV radiation is in this case molecular band radiation with a maximum at approx. 172 nm, which is emitted by $Xe^{2*}$ excimers formed in the discharge. The total area of the phosphor layer 12 corresponds to approximately 10% of the basis surface area of the front plate 3. Substantially the whole remaining part of the basic area, i.e. approx. 90%, functions as a mirror on account of the mirror surface 9. In the switched-on state of the device according to the invention explained above, diffuse, uniform illumination is achieved.

Although the exemplary embodiment explained above uses two partial regions which function as lamps and are in strip form in the plan view shown in FIG. 1*a*, the invention also, of course, encompasses only one or more than two such partial regions which illuminate in operation. By way of example, to increase the illumination strength, it may be advantageous, in the exemplary embodiment shown in FIG. 1*a*, to provide a further partial region functioning as a lamp at the upper edge of the illumination device, i.e. to provide a total of three such partial regions, or even, in addition, to provide a partial region of this type at the lower edge as well, i.e. a total of four such partial regions. Compared to the alternative of simply widening the strip-like partial regions, this has the advantage of a more favorable distribution of the illumination. Moreover, the partial regions mentioned do not necessarily have to be in strip form, but rather may have almost any desired contours. However, the desired size and shape of the mirror surface should be taken into account. In this connection, it should be mentioned that the basic shape of the illumination device according to the invention, i.e. ultimately the shape of the two plates, does not by any means have to be rectangular. Rather, numerous shapes are possible in this case too, and it is substantially esthetic considerations which should be to the fore when selecting the shape.

What is the claimed is:

1. A flat illumination device, comprising a base plate and a front plate, which are connected to form an at least partially transparent vessel which, in its interior, has an ionizable fill, at least one of the two plates, in a partial region of the vessel, being at least partially provided with a mirror surface, and an unmirrored partial region of the vessel being designed to realize an illumination function.

2. The illumination device as claimed in claim 1, in which the unmirrored partial region is provided with electrodes.

3. The illumination device as claimed in claim 2, in which the electrodes are arranged on the wall of the vessel in the form of a structure resembling a conductor track.

4. The illumination device as claimed in claim 3, in which at least some of the electrodes are separated from the ionizable fill by a dielectric.

5. The illumination device as claimed in claim 1, in which the vessel wall, in the partial region which is designed to realize the illumination function, is at least partially provided with a phosphor layer.

6. The illumination device as claimed in claim 1, in which one or more partitions are arranged between the plates in such a manner that the vessel is divided into two or more chambers and, as a result, the mirrored partial region is separated from the unmirrored partial region.

7. The illumination device as claimed in claim 1, in which the two plates are connected by a frame which is arranged between the two plates and runs around the edge regions of the two plates.

8. The illumination device as claimed in claim 1, in which the mirror surface corresponds to more than 50% of the front surface of the front plate.

9. The illumination device as claimed in claim 1, in which the partial region, which is designed to realize the illumination function, extends along at least a part of the edge region of the illumination device.

10. The illumination device as claimed in claim 9, in which the proportion made up by the partial region corresponds to more than 5% of the front surface of the front plate (3).

* * * * *